US010180245B1

(12) United States Patent
Tang

(10) Patent No.: US 10,180,245 B1
(45) Date of Patent: Jan. 15, 2019

(54) LAMP ASSEMBLY HAVING FIXTURE UNIT WITH ELECTRIC CONNECTING MECHANISM

(71) Applicant: Yi-Wen Tang, Taichung (TW)

(72) Inventor: Yi-Wen Tang, Taichung (TW)

( * ) Notice: Subject to any disclaimer, the term of this patent is extended or adjusted under 35 U.S.C. 154(b) by 0 days.

(21) Appl. No.: 15/915,051

(22) Filed: Mar. 7, 2018

(51) Int. Cl.

| | |
|---|---|
| ***F21V 23/00*** | (2015.01) |
| ***F21V 23/06*** | (2006.01) |
| ***F21V 17/12*** | (2006.01) |
| ***F21V 3/02*** | (2006.01) |

(52) U.S. Cl.
CPC ..... *F21V 23/06* (2013.01); *F21V 3/02* (2013.01); *F21V 17/12* (2013.01)

(58) Field of Classification Search
CPC ..... F21V 19/02; F21V 23/02; F21V 23/06; F21S 8/04
See application file for complete search history.

(56) References Cited

U.S. PATENT DOCUMENTS 7,168,670 B2 * 1/2007 Liang ..... F04D 25/088 248/342
7,300,248 B2 * 11/2007 Wang ..... F04D 25/088 248/343
9,797,581 B2 * 10/2017 Tang ..... F21V 19/02

* cited by examiner

*Primary Examiner* — Karabi Guharay

(57) ABSTRACT

A lamp assembly having fixture unit with electric connecting mechanism includes a fixture assembly which includes a fixed body, multiple conductive plates and multiple connectors. The fixed body has a first recessed area, multiple first slots, multiple second slots and multiple first connection portions. The conductive plates and the connectors are electrically connected to each other and are connected to the first connection portions. A lamp unit is connected to the fixed body and includes a base which has multiple hooks hooked with the first slots. Each hook has a third hole. A circuit board is located in the baes and includes light sources and multiple conductive pins. The conductive pins extend through the third holes and located in the second slots so as to be connected with the conductive plates to provide electric power to the circuit board.

13 Claims, 10 Drawing Sheets

LAMP ASSEMBLY HAVING FIXTURE UNIT WITH ELECTRIC CONNECTING MECHANISM

BACKGROUND OF THE INVENTION

1. Fields of the Invention

The present invention relates to a lamp assembly having fixture unit with electric connecting mechanism, and more particularly, to a fixed body that includes wires and conduct plates so that a lamp can be used when being connected to the light fixture assembly.

2. Descriptions of Related Art

The conventional lamp assembly is disclosed in U.S. Pat. No. 9,797,581, and comprises a first body adapted to be fixed to an object, and the first body has a protrusion protruding from a first side thereof. The protrusion is a four-side protrusion and has a flat surface. A first engaging portion is defined in the flat surface of the protrusion and is a circular recess. Two ribs are located diametrically in the first engaging portion. The width of the protrusion is a first length, and the second body is adapted to receive a light member therein. The second body has a second engaging portion at the center thereof. The second engaging portion is engaged with the first engaging portion. The second engaging portion has two connection slots which are located corresponding to the two ribs. Each of the two connection slots is an L-shaped slot and has an opening and a restriction portion. The ribs each enter into the restriction slot corresponding thereto from the opening and are engaged with the restriction portion. Four blocks extend from the top of the second body. One first guide path and three second guide paths are respectively and radially defined between the four blocks. A space is formed at the central portion of the second body and located between the four blocks. The protrusion is accommodated in the space. The second engaging portion is located at the center of the space. Each of the first and second guide paths opens through the periphery of the second body. The width of the first guide path is a second length. The second length is longer than the first length. The width of each of the second guide paths is a third length which is smaller than the first and second lengths. The opening of one of the two connection slots orientates the first guide path. Two pieces protrude from the top of the second body and are located in the first guide path. Each of the two pieces has an inclined ramp. One of the two pieces has a first face extending from one end of the inclined ramp. The first face is located close to the second engaging portion. The height of the first face is equal to or higher than the height of the second engaging portion. Each of the four blocks has a contact face and four sides of the protrusion contact the contact faces.

However, the second body has to be connected with the power wires and then connected to the first body, and the wires extend through and exposed from the first body. Besides, when connecting the wires to the second body, the second body is located above the user who cannot see the second engaging portion such that the wires are difficult to be connected to the second body. This always takes a lot of time and is not efficient.

The present invention intends to provide a lamp assembly that is designed to eliminate the drawbacks mentioned above.

SUMMARY OF THE INVENTION

The present invention relates to a lamp assembly and comprises a fixture assembly which includes a fixed body, multiple conductive plates and multiple connectors. The fixed body has a first recessed area, multiple first slots, multiple second slots and multiple first connection portions. The conductive plates and the connectors are electrically connected to each other and are connected to the first connection portions. A lamp unit is connected to the fixed body and includes a base which has multiple hooks hooked with the first slots. Each hook has a third hole. A circuit board is located in the baes and includes light sources and multiple conductive pins. The conductive pins extend through the third holes and located in the second slots so as to be connected with the conductive plates to provide electric power to the circuit board.

The advantages of the present invention are that the connectors and the conductive plates are pre-installed to the fixed body so that when the lamp unit is connected to the fixed body, the lamp unit is powered and ready for use without extra wiring. The hooks are engaged with the first slots, and the conductive pine are installed to the second slots to be electrically connected with the conductive plates to power the lamp unit. When removing the lamp from the fixed body, the conductive pins are separated from the conductive plates so that no electric power is supplied to the lamp unit.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
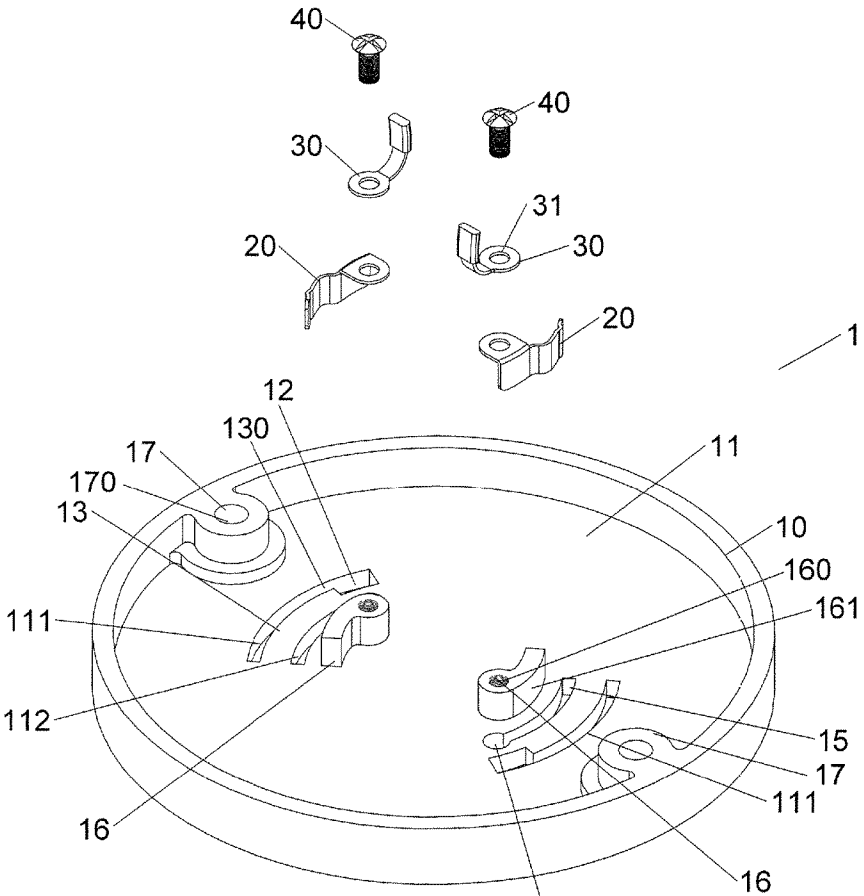
FIG. 1 is an exploded view of the fixture assembly of the present invention.
Figure 2:
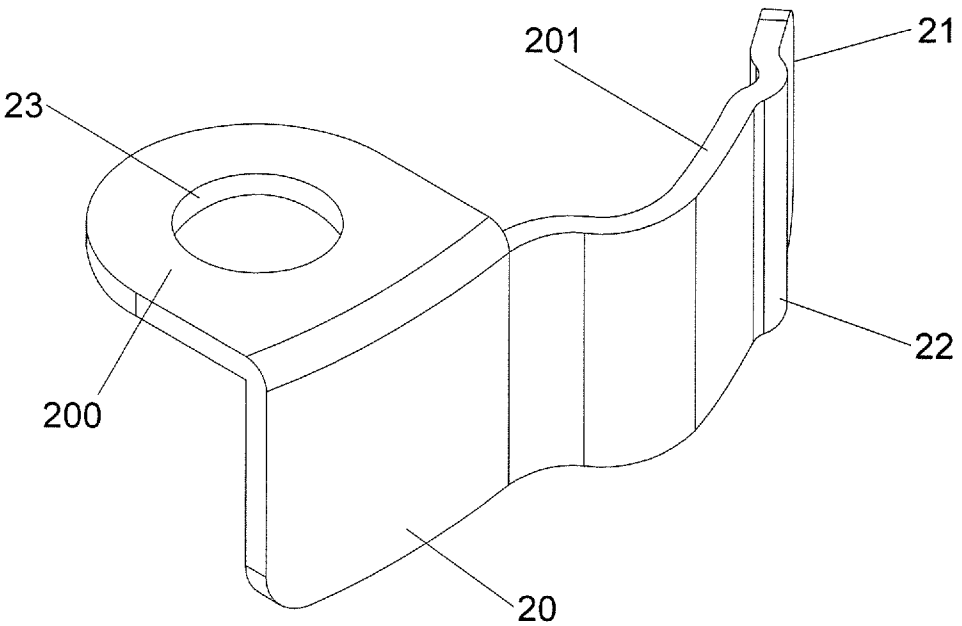
FIG. 2 show the conductive plates of the present invention.
Figure 3:
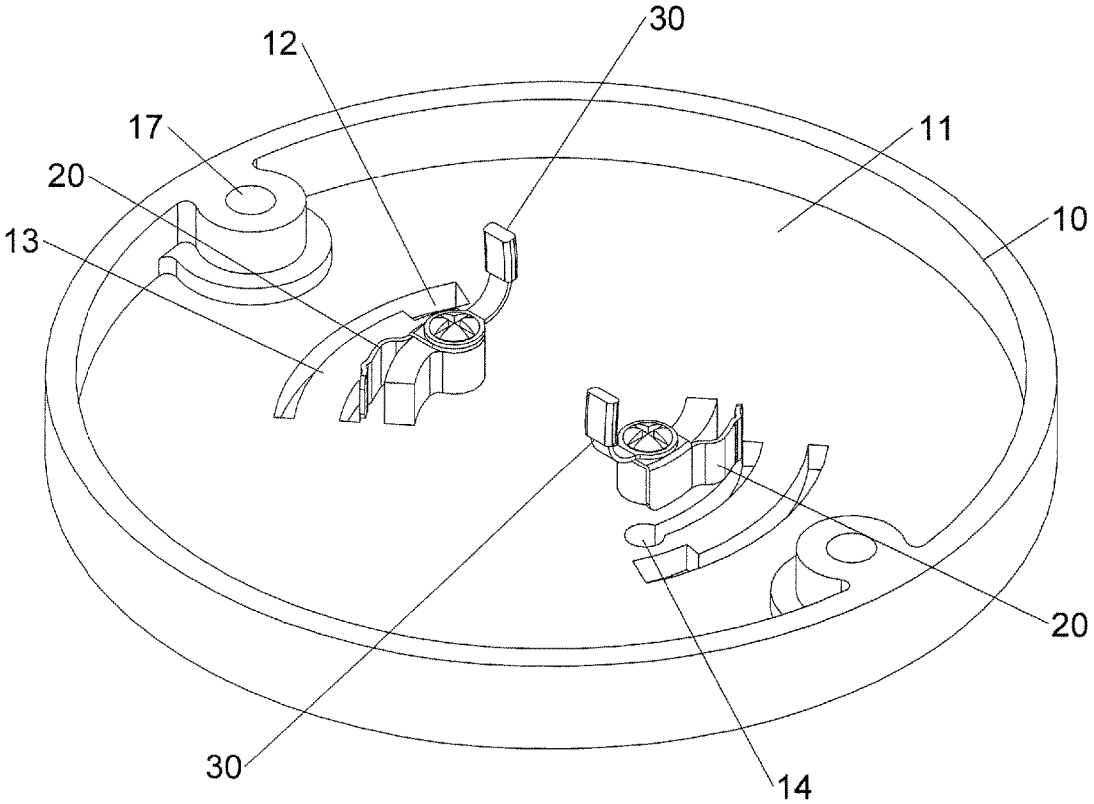
FIG. 3 is a perspective view to show the fixture assembly of the present invention.
Figure 4:
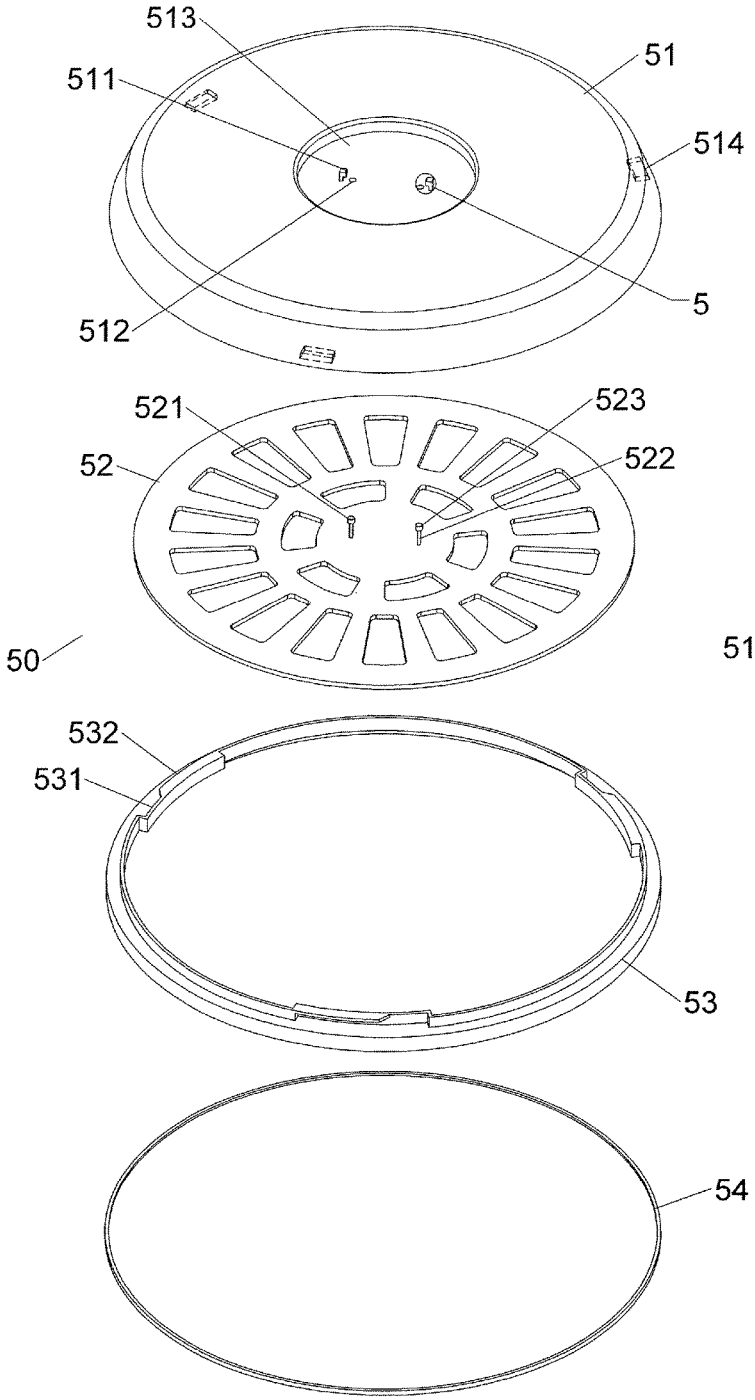
FIG. 4 is an exploded view of the lamp unit of the present invention.
Figure 5:
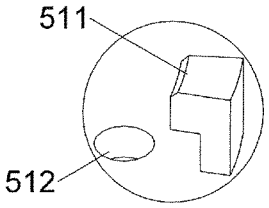
FIG. 5 is an enlarged view of the circled "5" in FIG. 4.
Figure 7:
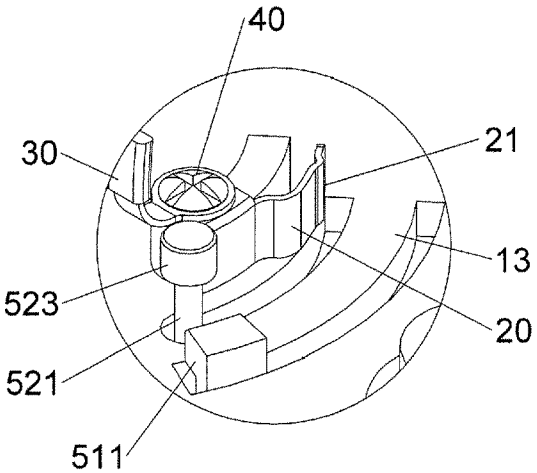
FIG. 7 is an enlarged view of the circled "7" in FIG. 6.

Referring to FIGS. 1 to 9, the lamp assembly of the present invention comprises a fixture assembly 1, multiple flexible conductive plates 20, multiple connectors 30, multiple fixing members 40 and a lamp unit 50. The fixture assembly 1 is to be fixed on a wall, a ceiling or any object, and comprises a round fixed body 10, the multiple flexible conductive plates 20, the multiple connectors 30, and the multiple fixing members 40.

The fixed body 10 includes a first recessed area 11 defined in the top thereof. Multiple arc first slots 111 and multiple arc second slots 112 are defined in the inner bottom of the first recessed area 11 and evenly spaced from each other. The first and second slots 111, 112 are located about the center of the first recessed area 11 by the same angle. The first slots 111 located on the outer position relative to the second slots 112. A separation wall 13 is located between the first and second slots 111, 112. Each first slot 111 has an enlarged rectangular first entrance 12 defined in the first end thereof so as to form an L-shaped notch 130 in the separation wall 13. Each second slot 112 has a second entrance 14 defined in the first end thereof, and an end wall 15 is formed in the second end of each second slot 112. The first entrance 12 is located beside the second entrance 14. The inner bottom of the first recessed area 11 has multiple first connection portion 16 and multiple second connection portions 17 formed therein. Each first connection portion 16 has a threaded engage hole 160, and each second connection portion 17 has a through hole 170. The number of the first and second connection portions 16, 17 are the same as that of the first and second slots 111, 112. By extending bolts through the second connection portions 17 to connect the fixed body 10 to a wall, a ceiling or an object. The first and second slots 111, 112 are arc slots, the outer wall 161 of the first connection portion 16 is an arc outer wall, so that the lamp unit 5 is installed to the fixture assembly 1 along an arc path.

The conductive plates 20 are respectively connected to the first connection portions 16. Each conductive plate 20 has a first end and a second end 21, wherein a first hole 23 is defined in a bended plate 200 protruding from a lateral side of the first end of each conductive plate 20, and the second end 21 of each conductive plate 20 is located corresponding to the end wall 15 of the second slot 112 corresponding thereto. The second end 21 of each conductive plate 20 is located remote from the second entrance 14. A ridge 22 protrudes from each conductive plate 20 and is located close to the second end 21. The first hole 23 of each conductive plate 20 is located corresponding to the first connection portion 16 corresponding thereto.

The connectors 30 are respectively connected to the first connection portions 16 and the conductive plates 20. There are two connectors 30 and two inner second slots 112. The two connectors 30 respectively perform as the positive connector and the negative connector for connecting a positive wire and a negative wire. The conductive plates 20 each is mounted on the first connection portion 16 together with the connector 30. Each connector 30 has a second hole 31 defined through one end thereof and the second hole 31 is located corresponding to the first hole 23. The connectors 30 are electrically connected to a power source to provide electric power to the conductive plates 20. The middle portion 201 of the conductive plate 20 is a curve-shaped protruding opposite to an arc outer wall 161 of the first connection portion 16, and the ridge 22 is located on the middle portion 201 of the conductive plate 20. There is a distance between the middle portion 201 of the conductive plate 20 and the arc outer wall 161 of the first connection portion 16.

The fixing members 40 are bolts which respectively extend through the second holes 31 of the connectors 30 and the first holes 23 of the conductive plates 20, and are mounted threadly with the engage hole 160 of the first connection portion 16 and are connected to the first connection portions 16 to connect the conductive plates 20 and the connectors 30 to the fixed body 10;

The lamp unit 50 is connected to the fixture assembly 1 and includes a round base 51, an electric circuit board 52, a collar 53 and a shade 54.

The base 51 has a second recessed area 513 defined centrally in the top thereof. Multiple hooks 511 and multiple third holes 512 are located in the inner bottom of the second recessed area 513. The hooks 511 extend through the first entrances 12 of the first slots 111, and the base 51 is rotated an angle relative to the fixed body 10 to allow the hooks 511 respectively be engaged with notch 130 in the separation wall 13 between the first and second slots 111, 112 so as to connect the base 51 to the fixed body 10. The third holes 512 are located corresponding to the second slots 112. The second recessed area 513 accommodates the fixture assembly 1.

The circuit board 52 is located in the base 51 and connected with at least one light source. The circuit board 52 has multiple conductive pins 521. Each conductive pin 521 has a post 522 and a head 523. The diameter of the head 523 is larger than the diameter of the post 522. The conductive pins 521 are located in the second slots 112 to be in contact with the conductive plates 20 to provide electric power from a power source to the circuit board 52. The conductive pins 521 protrude through the third holes 512, and the post 522 and the head 523 are exposed from the second recessed 513. When the fixture assembly 1 is connected to the lamp unit 50, the heads 523 extend through the second entrances 14. When the base 51 is rotated an angle relative to the fixed body 10, the conductive pins 521 move over the ridges 22 and contact the second ends 21 of the conductive plates 20. The heads 523 are engaged with the notches 130 of the separation walls 13.

The base 51 includes multiple engaging members 514 extending from the inner periphery thereof. The collar 53 is a ring-shaped collar and connected to the base 51. The collar 53 has multiple cavities with which the engaging members 514 are engaged. The cavities each have an opening 531 and an engaging portion 532 which is an L-shaped recess and communicates with the opening 531. The engaging member 514 is movable between the opening 531 and the engaging portion 532. When the engaging members 514 are located corresponding to the openings 531, the collar 53 is rotated to move the engaging members 514 to the engaging portions 532 to connect the collar 53 to the base 51.

The shade 54 is connected to the collar 53 to close the openings 531 and the base 51. The shade 54 is a transparent or translucent circular shade.

When assembling the fixture assembly 1 and the lamp unit 50, the hooks 511 and the conductive pins 521 respectively extend through the first and second entrances 12, 14. The lamp unit 50 is rotated an angle relative to the fixture assembly 1 to hook the hooks 511 with the separation wall 13, and the posts 522 are moved over the ridges 22 and contact the second ends 21 of the conductive plates 20. The heads 523 are in contact the second ends 21 of the conductive plates 20. The connectors 30 introduce electric power from a power source to the conductive plate 20, the conductive pins 521, the circuit board 52 and the at least one light source.

Figure 10:
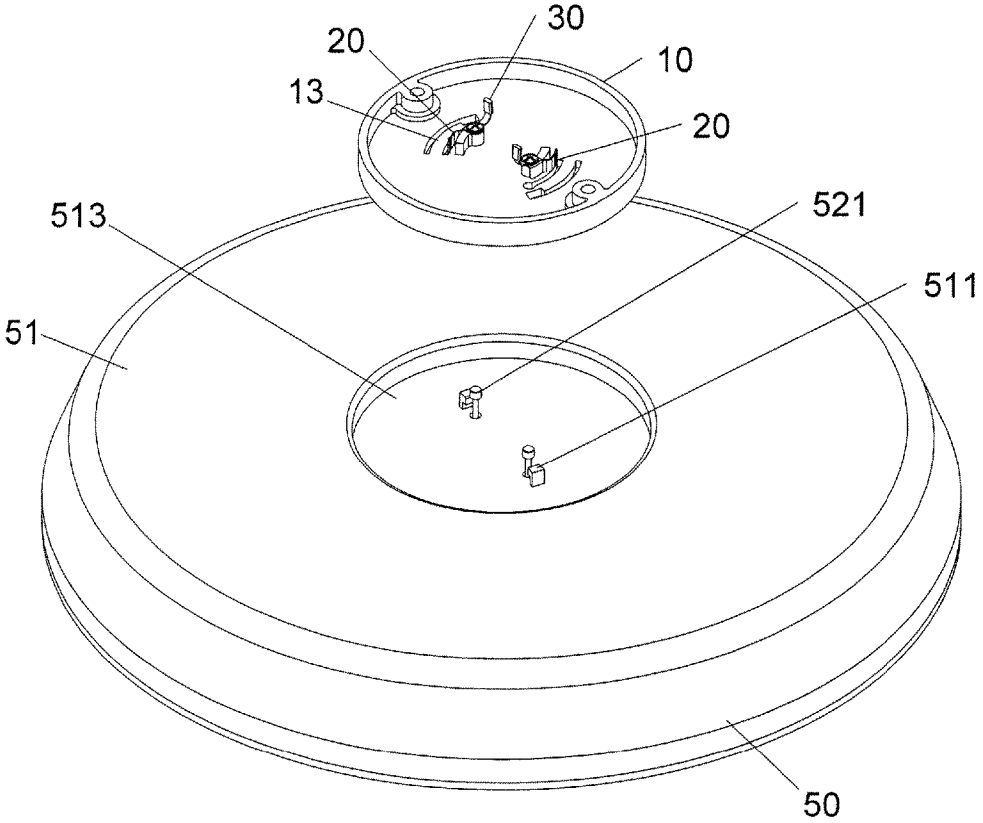
FIG. 10 shows the third operative status of the present invention.

As shown in FIG. 10, when removing the lamp unit 50 from the fixture assembly 1, the lamp unit 50 is rotated reversely to move the hooks 511 and the conductive pins 521 respectively to the first and second entrances 12, 14, such that the lamp unit 50 can be removed from the fixture assembly 1. The conductive pins 521 are separated from the conductive plate 20 so that there will be no electric power provided between the lamp unit 50 from the fixture assembly 1.

Figure 6:
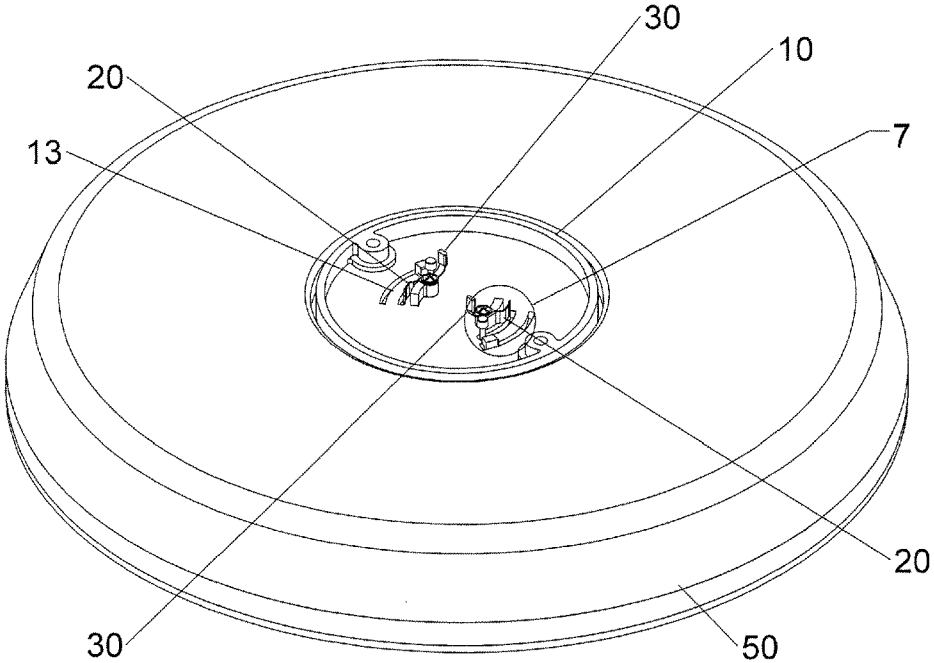
FIG. 6 is a perspective view of the lamp assembly of the present invention.
Figure 8:
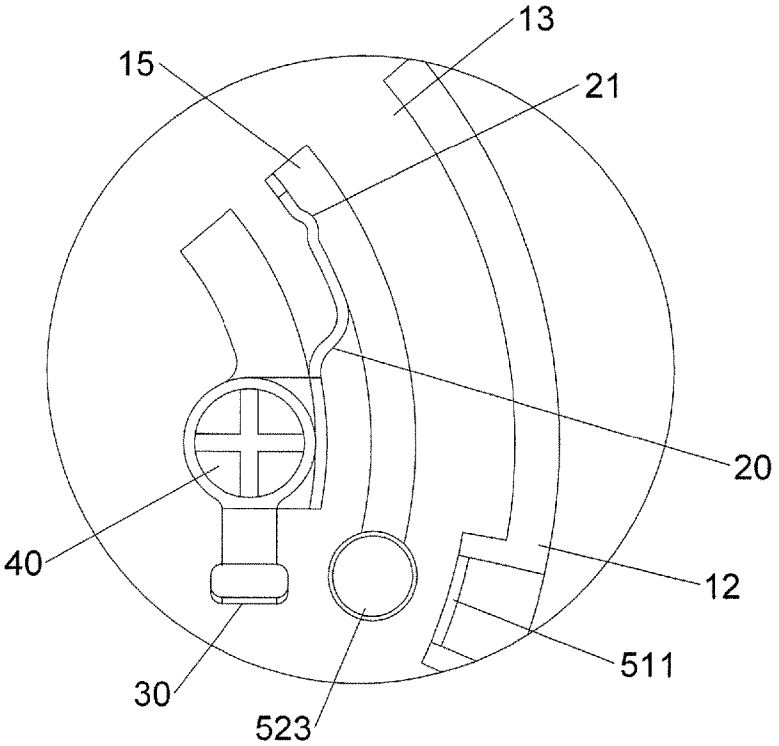
FIG. 8 is a top view of the circled "7" in FIG. 6.
Figure 9:
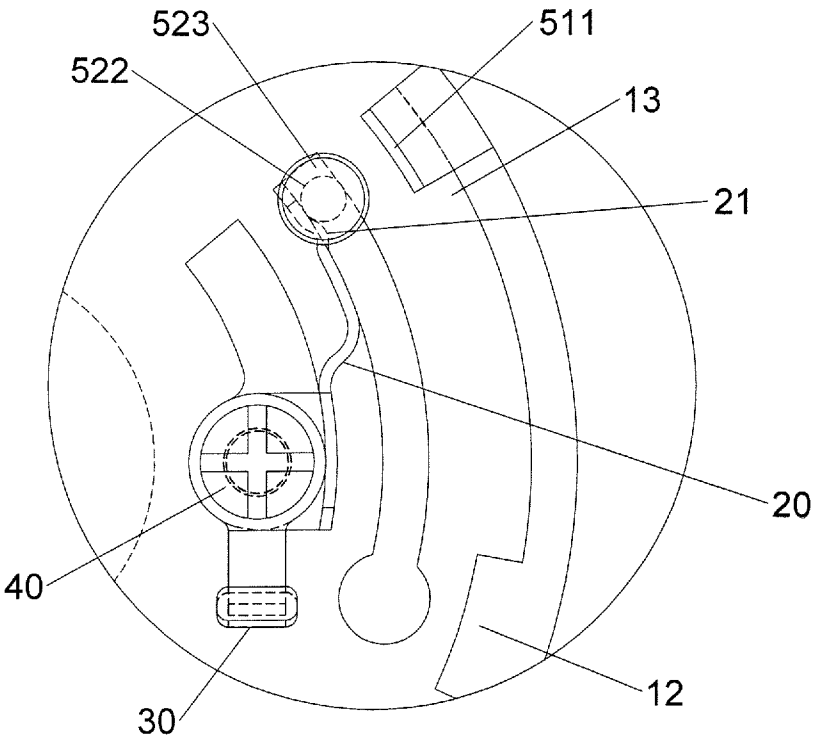
FIG. 9 is a top view of the circled "7" in FIG. 6 to show the second operative status thereof.
Figure 11:
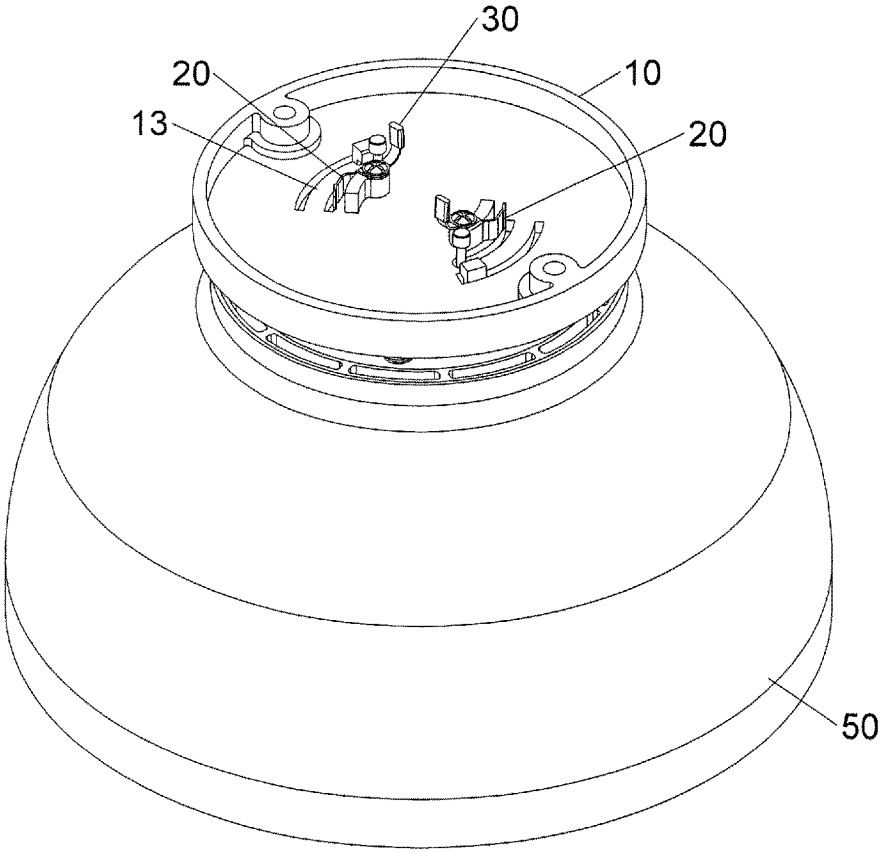
FIG. 11 shows the second embodiment of the present invention.

FIG. 11 shows that the fixture assembly 1 can be connected with different types of lamp units 50 as shown in the FIGS. 6 and 11.

Figure 12:
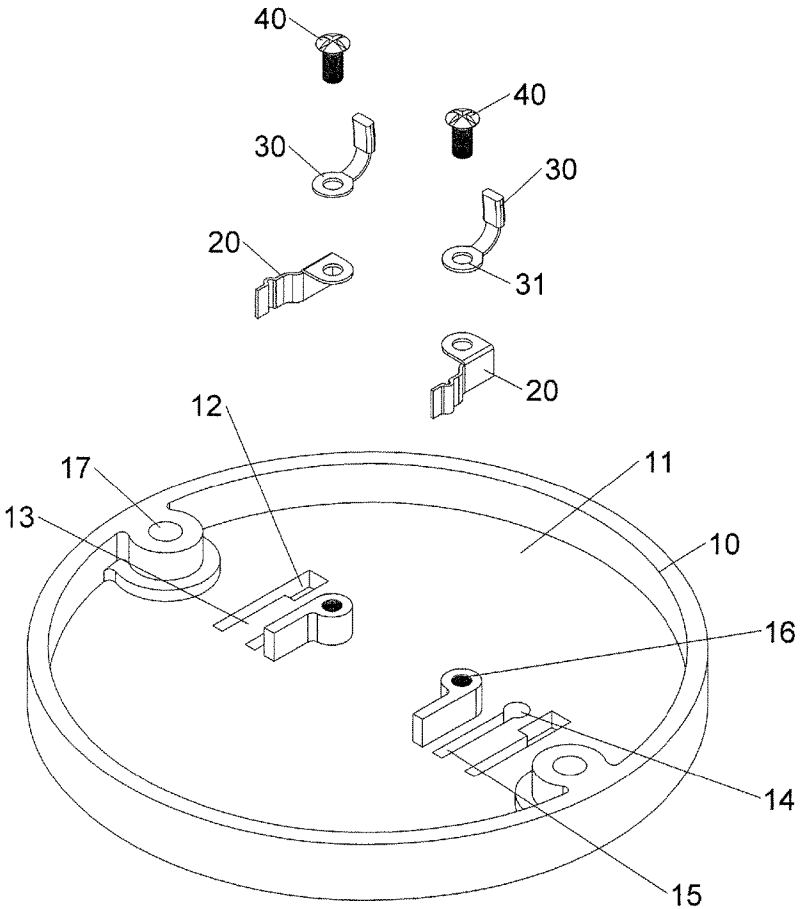
FIG. 12 an exploded view of the fixture assembly of the third embodiment of the present invention.

As shown in FIG. 12, the first and second slots 111, 112 are straight slots. The lamp unit 50 is installed to the fixture assembly 1 along a straight path.

The advantages of the present invention are that the connectors 30 and the conductive plates 20 are pre-installed to the fixed body 10 so that when the lamp unit 50 is connected to the fixed body 10, the lamp unit 50 is powered and ready for use without extra wiring.

The hooks 511 are engaged with the first slots 111, and the conductive pine 521 are installed to the second slots 112 to be electrically connected with the conductive plates 20 to power the lamp unit 50.

When removing the lamp unit 50 from the fixed body 10, the conductive pins 521 are separated from the conductive plates 20 so that no electric power is supplied to the lamp unit 50.

The hooks 511 are movable between the first entrances 12 and the separation wall 13, and the conductive pins 521 are movable between the second entrances 14 and the end walls 15. The hooks 511 hook the separation wall 13, and the conductive pins 521 are engaged with the end walls 15 by rotating the lamp unit 50. The lamp unit 50 is double locked with the fixture assembly 1.

When the conductive pins 521 are moved from the second entrances 14 to the end walls 15, the conductive pins 521 are moved over the ridges 22 and contact the second ends 21 of the conductive plates 20 and the end walls 15. The heads 523 contact one side of the conductive plates 20. The connectors 30 provide electric power to the conductive plates 20 which provide electric power to the conductive pins 521 to activate the circuit board 52. The conductive pins 521 has the features of transferring electric power and secured.

While we have shown and described the embodiment in accordance with the present invention, it should be clear to those skilled in the art that further embodiments may be made without departing from the scope of the present invention.

What is claimed is:

1. A lamp assembly having fixture unit with electric connecting mechanism comprising:

a fixture assembly having a fixed body that has a first recessed area defined in a top thereof, multiple first slots and multiple second slots defined in an inner bottom of the first recessed area, the first and second slots being located about a center of the first recessed area, the first slots located on an outer position relative to the second slots, each first slot having a first entrance defined in a first end thereof, each second slot having a second entrance defined in a first end thereof, an end wall formed in a second end of each second slot, the first entrance located beside the second entrance, the inner bottom of the first recessed area having multiple first connection portion and multiple second connection portions formed therein, each first connection portion having an engage hole, each second connection portion having a through hole;

multiple conductive plates respectively connected to the first connection portions, each conductive plate having a first end and a second end, a first hole defined in the first end of each conductive plate, the second end of each conductive plate located corresponding to the end wall of the second slot corresponding thereto, a ridge protruding from each conductive plate and located close to the second end, the first hole of each conductive plate located corresponding to the first connection portion corresponding thereto;

multiple connectors respectively connected to the first connection portions and the conductive plates, the multiple connectors respectively connecting at least one positive wire and at least one negative wire, each connector having a second hole defined through one end thereof, the connectors adapted to be electrically connected to a power source to provide electric power to the conductive plates;

multiple fixing members respectively extending through the second holes of the connectors and the first holes of the conductive plates, and being mounted with the engaged hole and being connected to the first connection portions to connect the conductive plates and the connectors to the fixed body;

a lamp unit connected to the fixture assembly and having a base which has a second recessed area defined centrally in a top thereof, multiple hooks and multiple third holes located in an inner bottom of the second recessed area, the hooks extending through the first entrances of the first slots, and respectively engaged with a separation wall between the first and second slots so as to connect the base to the fixed body, the third holes being located corresponding to the second slots, the second recessed area accommodating the fixture assembly, and a circuit board located in the base and being connected with at least one light source, the circuit board having multiple conductive pins, when the fixture assembly is connected to the lamp unit, the conductive pins are located in the second slots and electrically connected with the conductive plates, the conductive pins extend through the third holes and are exposed beyond the second recessed area of the base, the conductive pins protrude into the second entrances of the fixed body so that each conductive pin is movable between the second entrance and the end wall so as to move over the ridge of the conductive plate and to contact the second end of the conductive plate corresponding thereto, each conductive pin having a post and a head, a diameter of the head is larger than a diameter of the post, the post and the head extending through the third hole and the second entrance such that the head protrudes beyond the second entrance and is located within the first recessed area and contacts a side of the conductive plate.

2. The lamp assembly as claimed in claim 1, wherein the fixture assembly is adapted to be fixed to a wall or a ceiling.

3. The lamp assembly as claimed in claim 1, wherein the fixed body is a circular body and the first recessed area is a circular recessed area.

4. The lamp assembly as claimed in claim 1, wherein the base is a circular base.

5. The lamp assembly as claimed in claim 1, wherein the base includes multiple engaging members extending from an inner periphery thereof, a collar is a ring-shaped collar and connected to the base, the collar has multiple cavities with which the engaging members are engaged, the cavities each have an opening and an engaging portion which is an L-shaped recess and communicates with the opening, the engaging member is movable between the opening and the engaging portion, when the engaging members are located corresponding to the openings, the collar is rotated to move the engaging members to the engaging portions to connect the collar to the base, a shade is connected to the collar to close the openings and the base, the shade is a transparent or translucent circular shade.

6. The lamp assembly as claimed in claim 1, wherein when the lamp unit is separated from the fixed body of the fixture assembly, the lamp unit is rotated to respectively move the hooks and the conductive pins to the first and second entrances of the fixed body, the hooks are separated from the separation portion, the conductive pins are separated from the end walls and the second end of the conductive plates, the lamp unit are not electrically connected to the fixed body.

7. The lamp assembly as claimed in claim 1, wherein the first and second slots are straight slots, the lamp unit is installed to the fixture assembly along a straight path.

8. The lamp assembly as claimed in claim 1, wherein the first and second slots are curved slots.

9. The lamp assembly as claimed in claim 1, wherein the first entrances each are a rectangular entrance, the separation wall each include an L-shaped notch, the second entrances are a round entrance.

10. The lamp assembly as claimed in claim 1, wherein a middle portion of the conductive plate is a curve-shaped protruding opposite to an outer wall of the first connection portion, the ridge is located on the middle portion of the conductive plate, and there is a distance between the middle portion of the conductive plate and the outer wall of the first connection portion.

11. The lamp assembly as claimed in claim 10, wherein the first and second slots are arc slots, the outer wall of the first connection portion is an arc outer wall, the lamp unit is installed to the fixture assembly along an arc path.

12. The lamp assembly as claimed in claim 1, wherein the fixing member is mounted threadly with the engaged hole.

13. The lamp assembly as claimed in claim 1, wherein the first hole is defined in a bended plate which protruding from a lateral side of the first end of each conductive plate.

* * * * *